US006764418B1

(12) United States Patent
Lee

(10) Patent No.: US 6,764,418 B1
(45) Date of Patent: Jul. 20, 2004

(54) STRINGER OF A RACKET

(76) Inventor: Min-Wei Lee, P.O. Box 55-124, Taichung (TW)

( * ) Notice: Subject to any disclaimer, the term of this patent is extended or adjusted under 35 U.S.C. 154(b) by 0 days.

(21) Appl. No.: 10/426,870

(22) Filed: May 1, 2003

(51) Int. Cl.[7] ..... A65B 51/14
(52) U.S. Cl. ..... 473/557; 473/555; 473/556
(58) Field of Search ..... 473/554–557

(56) References Cited

U.S. PATENT DOCUMENTS 4,546,977 A * 10/1985 Bosworth et al. ..... 473/555
5,186,505 A * 2/1993 Chu ..... 473/555
5,338,028 A * 8/1994 Sung ..... 473/556
5,568,921 A * 10/1996 Lorentzen et al. ..... 473/556
5,590,877 A * 1/1997 Ho ..... 473/556

* cited by examiner

*Primary Examiner*—Raleigh W. Chiu

(57) ABSTRACT

A racket stringer includes a work table, and two opposite fixing devices each mounted on the work table and each including a rack, a guide plate, two foot posts, a support shaft, and a press rod. Thus, the fixing device has a quick positioning microadjustment function. In addition, the fixing device can be displaced easily and rapidly, thereby facilitating the user operating the racket sag stringer.

10 Claims, 7 Drawing Sheets

STRINGER OF A RACKET

BACKGROUND OF THE INVENTION

1. Field of the Invention

The present invention relates to a stringer of a racket, and more particularly to a racket stringer having a frame fixing device with a quick positioning microadjustment function.

2. Description of the Related Art

A conventional racket stringer in accordance with the prior art shown in FIGS. 1 and 2 comprises a work table 1, and two opposite fixing devices 3 each mounted on the work table 1. Each of the fixing devices 30 includes a guide plate 2 mounted on the work table 1 and formed with an elongated guide slot 202, a base 4 slidably mounted on the guide plate 2 and has a bottom 402 provided with two pins 404 slidably mounted in the guide slot 202, a locking bolt 5 having a first end formed with a rotation head 502 and a second end extended through a washer 504 and the guide slot 202 and screwed into the bottom 402 of the base 4, two clamping arms 7 mounted on the base 4, an angle mechanism 9 mounted on the base 4 and provided with a rotation knob 902 to control the included angle between the two clamping arms 7, and a control mechanism 8 mounted on the base 4 and provided with a control knob 802 to move a resting plate 804 forward and backward.

In operation, the locking bolt 5 is unscrewed from the bottom 402 of the base 4, so that the base 4 can be moved freely, and the two fixing devices 3 can be moved outward relative to each other to reach the position of the frame of the racket. Then, the locking bolt 5 is screwed on the bottom 402 of the base 4, so that the base 4 is fixed. Then, the control knob 802 is rotated to move a resting plate 804 to rest on the inner periphery of the frame of the racket, and the rotation knob 902 is rotated to move the two clamping arms 7 to rest on the outer periphery of the frame of the racket, so that the frame of the racket is clamped between the two opposite fixing devices 30 for stretching the strings of the racket.

However, each of the two opposite fixing devices 3 cannot be moved easily and conveniently, thereby greatly causing inconvenience to the user. In addition, the user needs to successively screw and unscrew the locking bolt 5 to position and release the fixing device 3, thereby causing inconvenience to the user in use. Further, the fixing device 3 does not have a microadjustment function, so that the position of the fixing device 3 cannot be microadjusted.

SUMMARY OF THE INVENTION

The present invention is to mitigate and/or obviate the disadvantage of the conventional racket stringer.

The primary objective of the present invention is to provide a racket stringer having a frame fixing device that has a quick positioning microadjustment function.

Another objective of the present invention is to provide a racket stringer, wherein the frame fixing device can be displaced easily and rapidly, thereby facilitating the user operating the racket stringer.

A further objective of the present invention is to provide a racket stringer, wherein the frame fixing device can be positioned easily and rapidly, thereby facilitating the user operating the racket stringer.

In accordance with the present invention, there is provided a racket stringer, comprising a work table, and two opposite fixing devices each mounted on the work table and each including a rack, a guide plate, two foot posts, a support shaft, and a press rod, wherein:

the rack is mounted on the top of the work table and has a top face formed with a plurality of oneway ratchet teeth;

the guide plate is mounted on the top of the work table and is formed with two elongated guide-slots each parallel with the rack;

each of the two foot posts is slidably mounted on the guide plate and has a bottom provided with a slide slidably mounted in a respective one of the two guide slots of the guide plate, thereby guiding the fixing device to displace on the work table reciprocally;

the support shaft is rotatably mounted between the two foot posts; and the press rod is extended through the support shaft and has a first end rested on the ratchet teeth of the rack and a second end formed with a rotation head for rotating the press rod.

Further benefits and advantages of the present invention will become apparent after a careful reading of the detailed description with appropriate reference to the accompanying drawings.

DETAILED DESCRIPTION OF THE INVENTION

Figure 1:
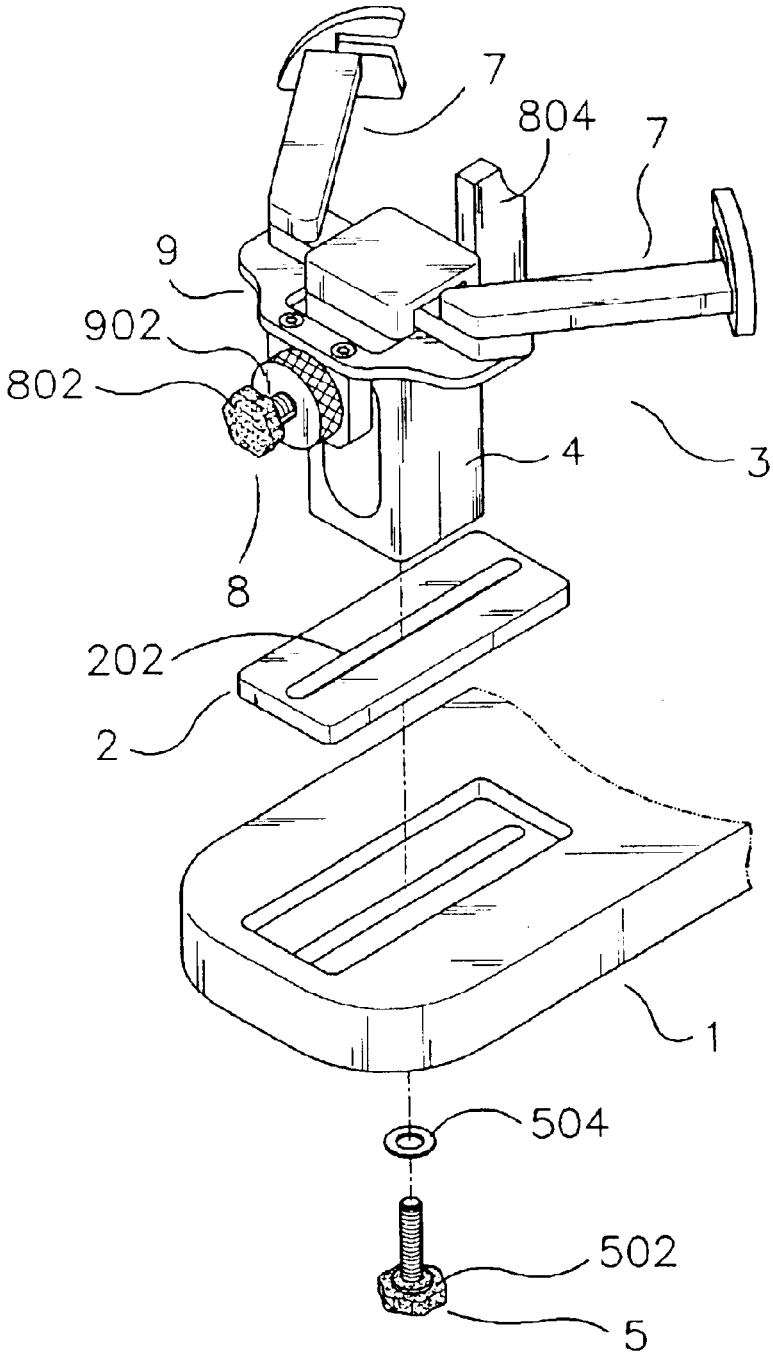
FIG. 1 PRIOR ART
FIG. 1 is an exploded perspective view of a conventional racket stringer in accordance with the prior art.
Figure 2:
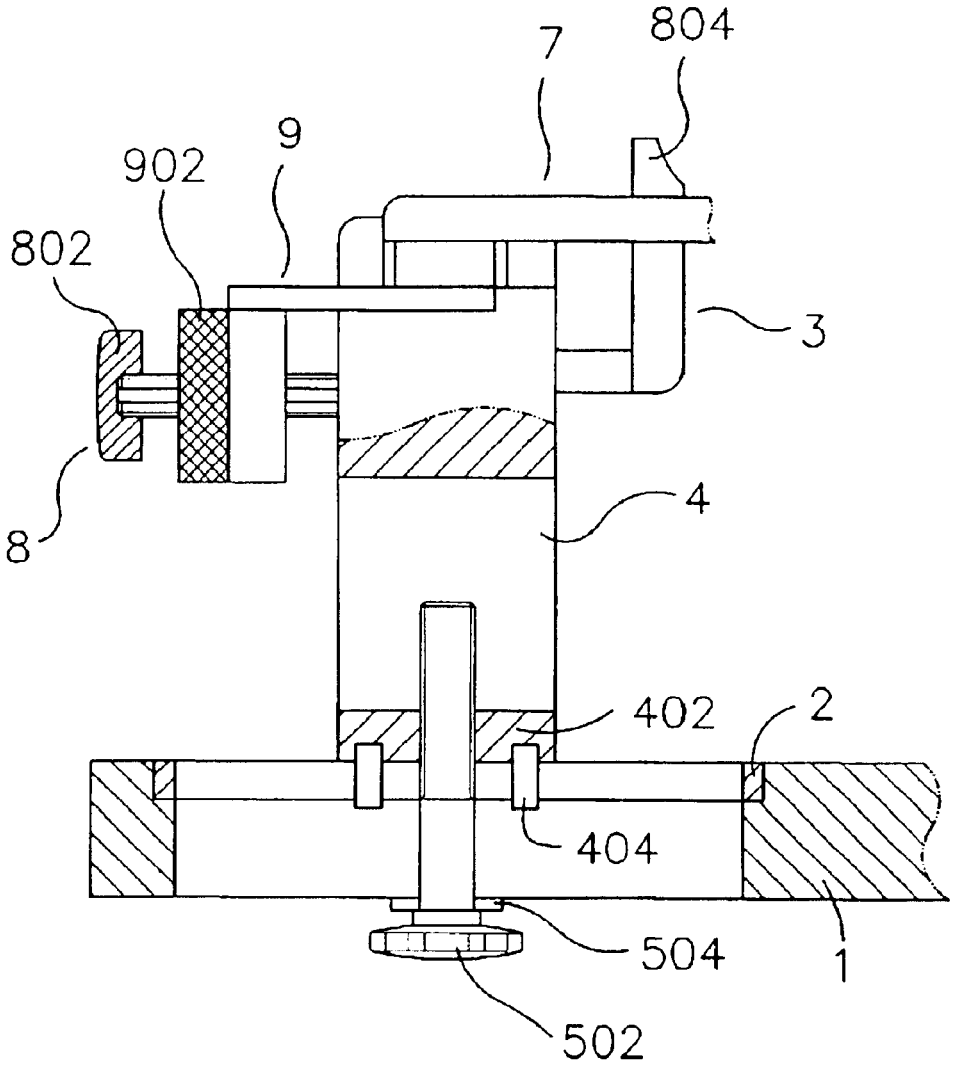
FIG. 2 PRIOR ART
FIG. 2 is a side plan cross-sectional assembly view of the racket stringer as shown in FIG. 1.
Figure 3:
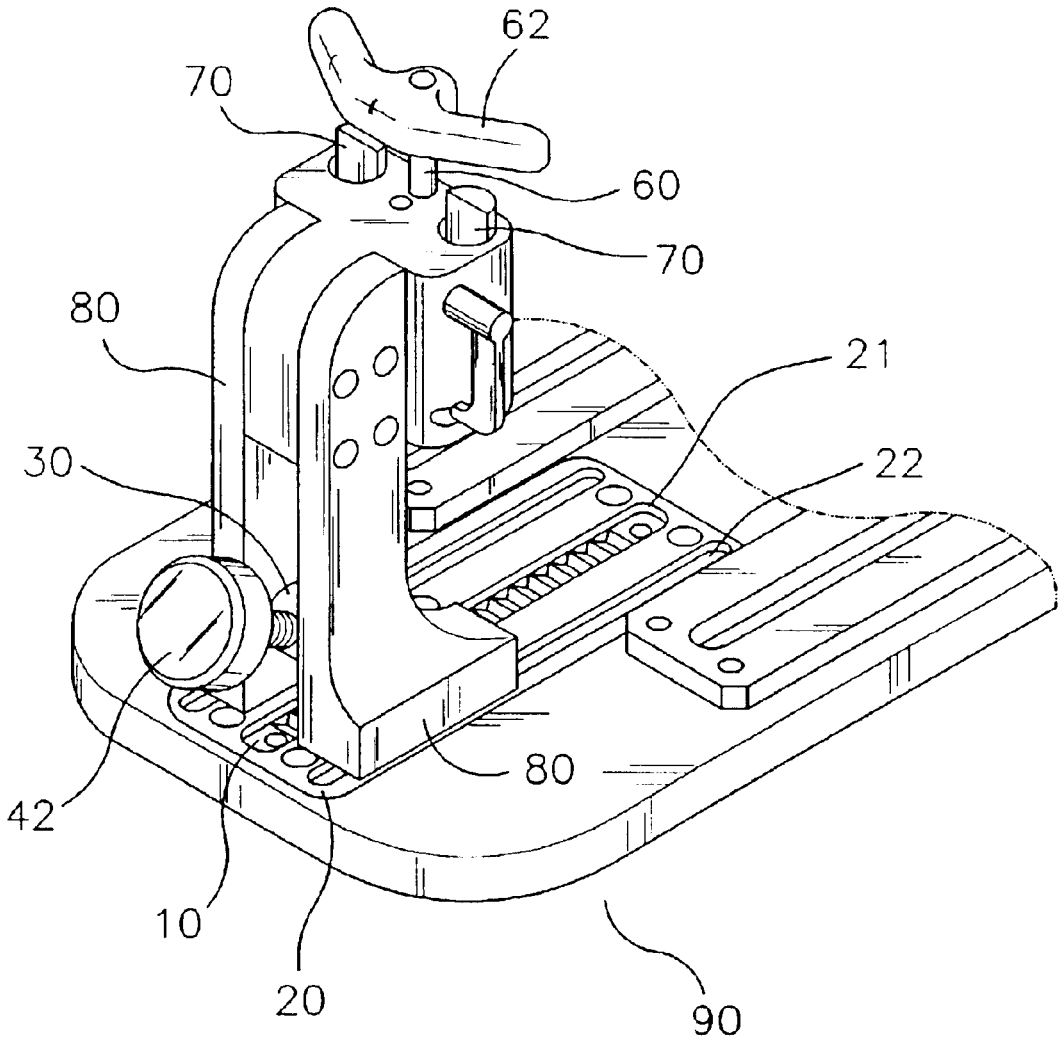
FIG. 3 is a perspective view of a racket stringer in accordance with the preferred embodiment of the present invention.
Figure 4:
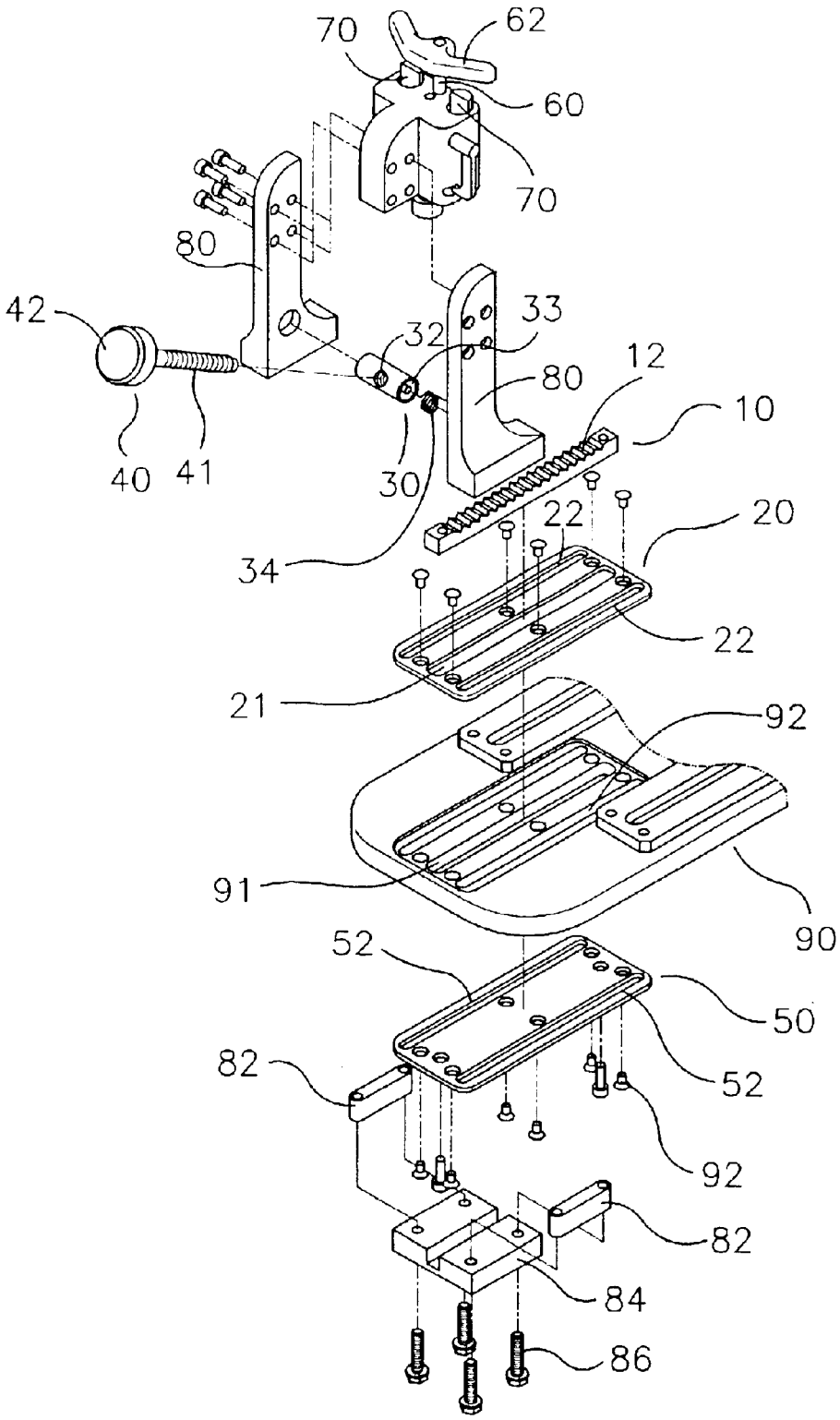
FIG. 4 is an exploded perspective view of the racket stringer in accordance with the preferred embodiment of the present invention.
Figure 5:
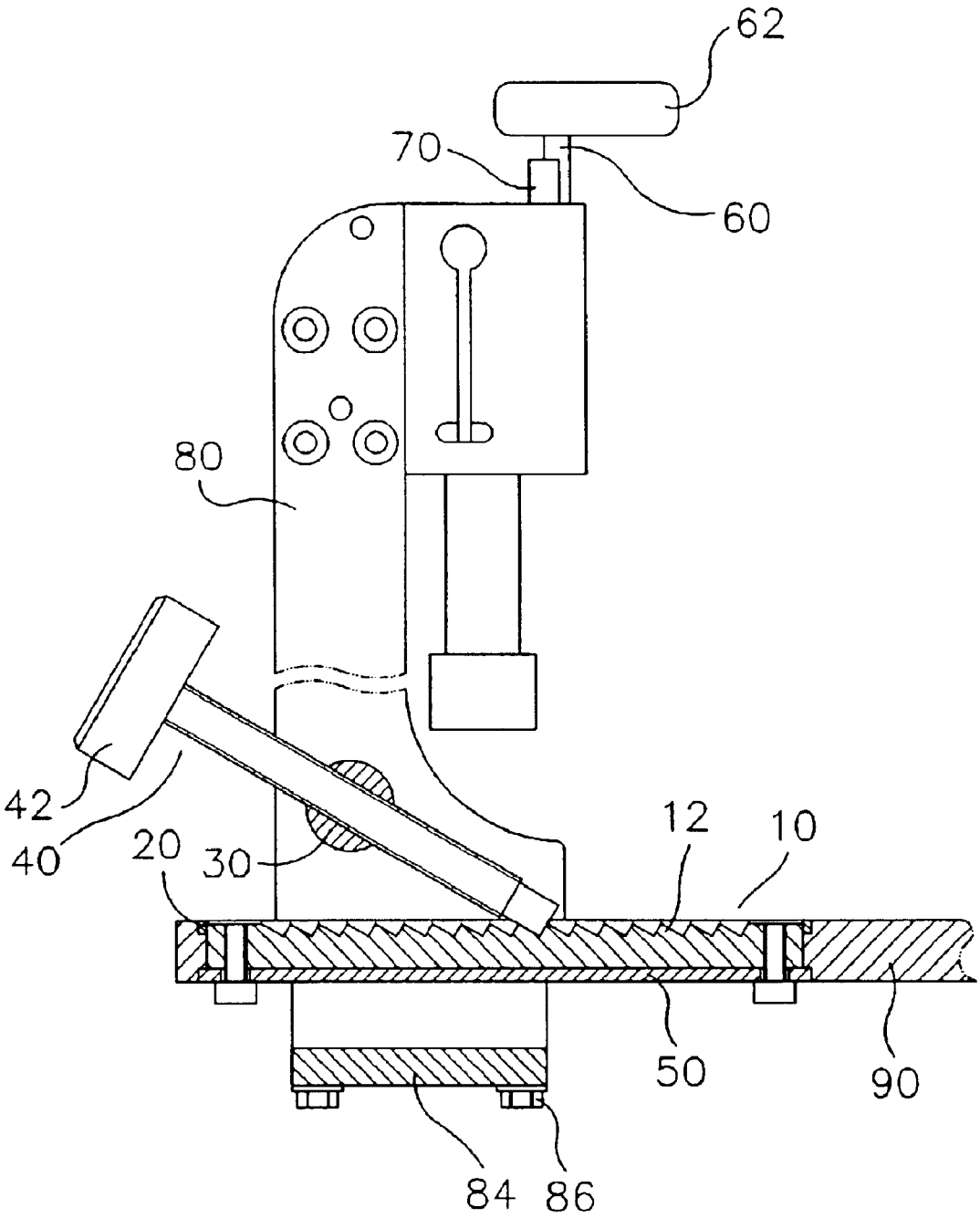
FIG. 5 is a side plan cross-sectional view of the racket stringer as shown in FIG. 3.

Referring to the drawings and initially to FIGS. 3–5, a racket stringer in accordance with the preferred embodiment of the present invention comprises a work table 90, and two opposite fixing devices each mounted on the work table 90.

Each of the fixing devices includes a rack 10, a guide plate 20, two foot posts 80, a support shaft 30, and a press rod 40.

The rack 10 is mounted on the top of the work table 90 and has a top face formed with a plurality of oneway ratchet teeth 12.

The guide plate 20 is mounted on the top of the work table 90 and is formed with two elongated guide slots 22 each parallel with the rack 10. Preferably, the guide plate 20 is formed with a receiving slot 21 to receive the rack 10.

Each of the two foot posts 80 is slidably mounted on the guide plate and has a bottom provided with a slide 82 slidably mounted in a respective one of the two guide slots 22 of the guide plate 20, thereby guiding the fixing device to displace on the work table 90 reciprocally.

The support shaft 30 is rotatably mounted between the two foot posts 80.

The press rod 40 is extended through the support shaft 30 and has a first end rested on the ratchet teeth 12 of the rack 10 and a second end formed with a rotation head 42 for rotating the press rod 40.

The work table 90 is formed with two elongated guide slots 92 each aligning with a respective one of the two guide slots 22 of the guide plate 20 for guiding the slide 82 of a respective one of the two foot posts 80. The work table 90 is formed with a receiving slot 91 to receive the rack 10.

Each of the fixing devices further includes a support plate 50 mounted on the bottom of the work table 90 for supporting and securing the rack 10, and a plurality of locking screws 92 each extended through the support plate 50 and the work table 90 and each locked in the guide plate 20, so that the support plate 50, the work table 90 and the guide plate 20 are combined with each other. The support plate 50 is formed with two elongated guide slots 52 each aligning with a respective one of the two guide slots 92 of the work table 90 for guiding the slide 82 of a respective one of the two foot posts 80.

Each of the fixing devices further includes a connecting seat 84 mounted on the bottom of the support plate 50 and secured on the slides 82 of the two foot posts 80, and a plurality of locking bolts 86 each extended through the connecting seat 84 and the slides 82 and each locked in a respective one of the two foot posts 80, so that the two foot posts 80 are limited to move on the guide plate 20 by the connecting seat 84 without detachment.

The support shaft 30 is formed with a screw bore 32, and the press rod 40 is formed with an outer thread 41 screwed into the screw bore 32 of the support shaft 30. Each of the fixing devices further includes a torsion spring 34 mounted between the support shaft 30 and one of the two foot posts 80 and having a first end secured on the support shaft 30 and a second end secured on the respective foot post 80. Preferably, the support shaft 30 has an end formed with a receiving recess 33 to receive the torsion spring 34.

Each of the fixing devices further includes a support base 60 mounted between the two foot posts 80 and having a top provided with a press plate 62, and two positioning posts 70 mounted on the support base 60. Thus, the periphery of the annular frame (not shown) of the racket (not shown) is mounted on the two positioning posts 70 and is pressed by the press plate 62, thereby positioning the racket for stretching the strings (not shown) of the racket.

Figure 6:
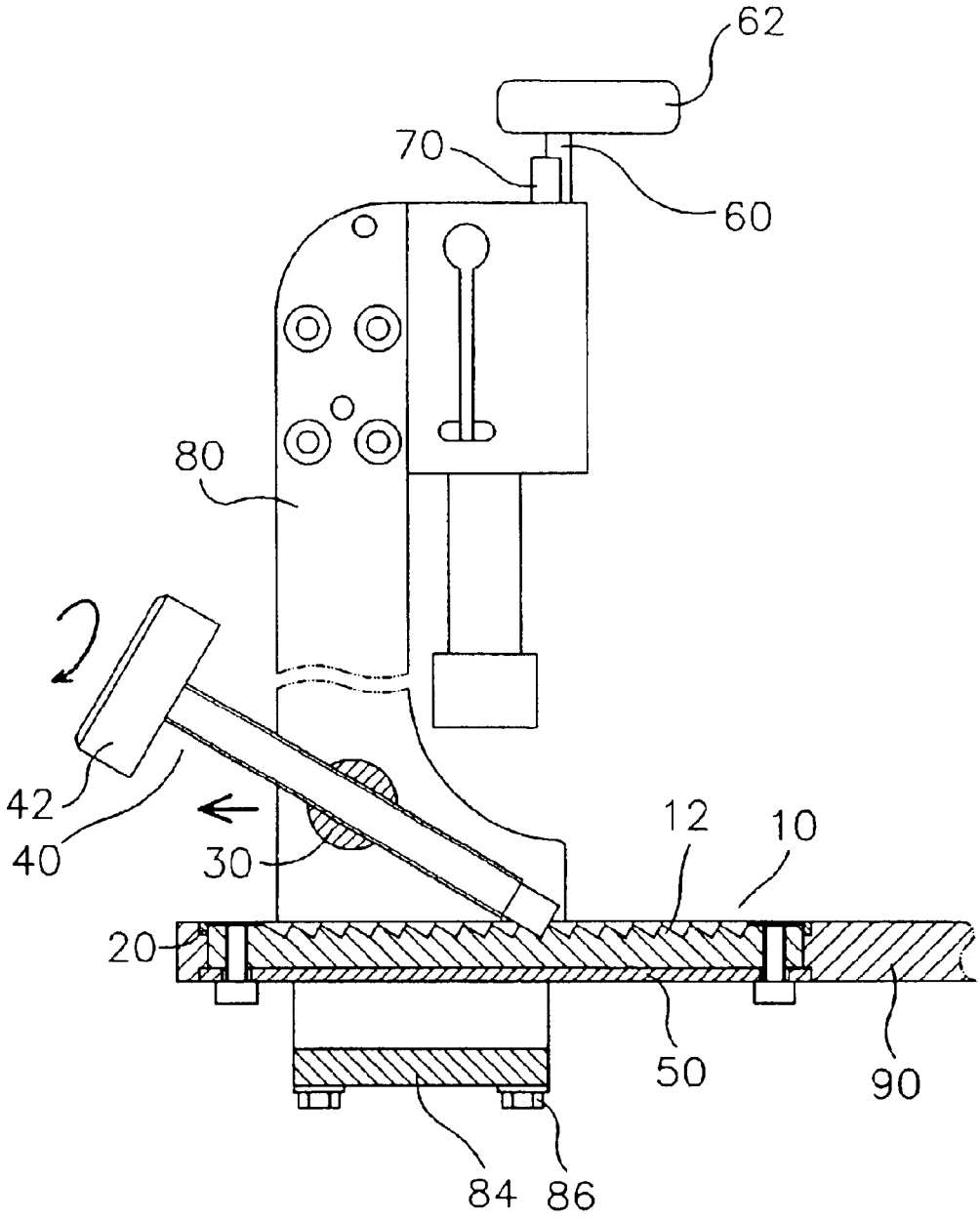
FIG. 6 is a schematic operational view of the racket stringer as shown in FIG. 5.
Figure 7:
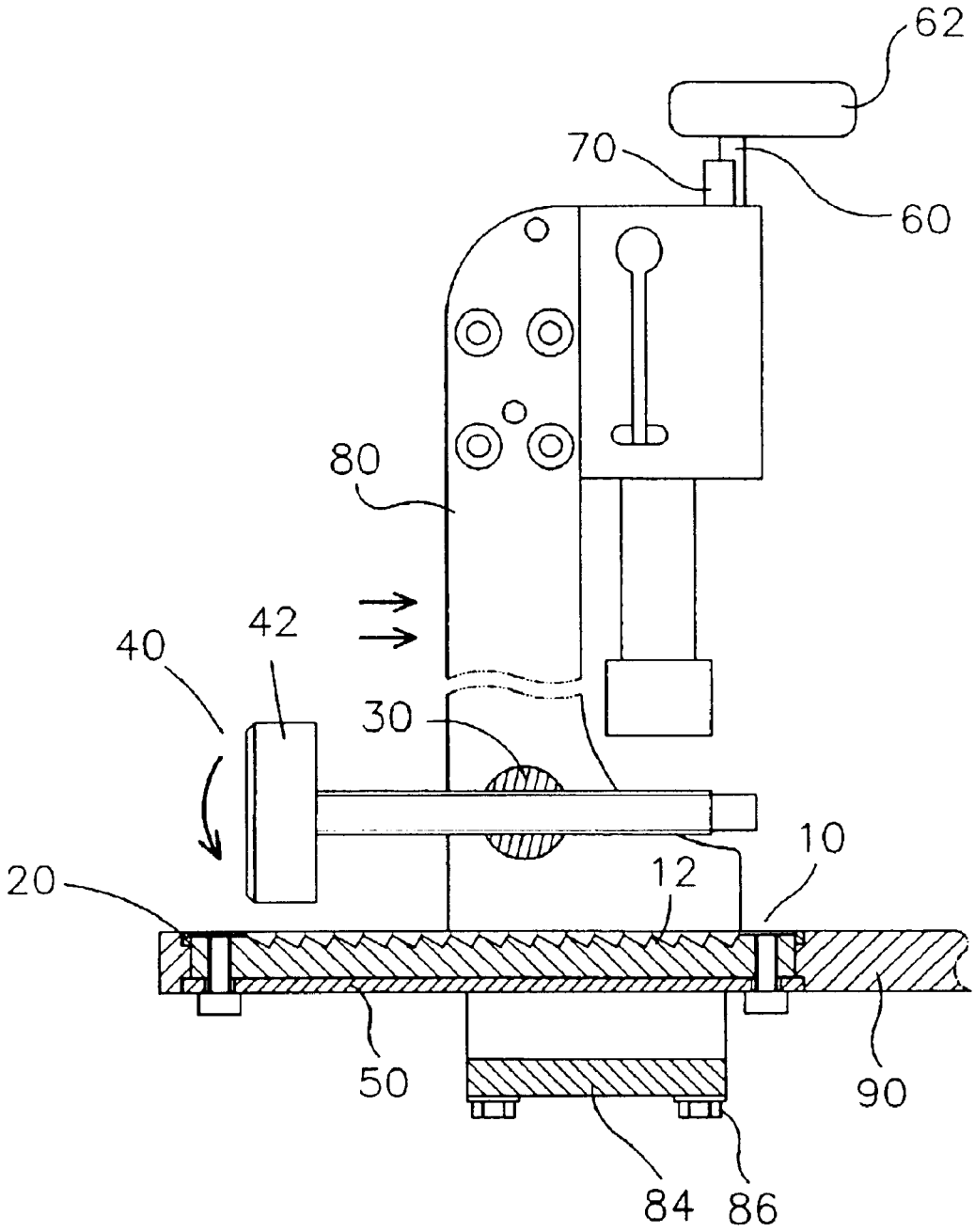
FIG. 7 is a schematic operational view of the racket stringer as shown in FIG. 5.

In operation, referring to FIGS. 5–7 with reference to FIGS. 3 and 4, the two opposite fixing devices are pushed outward relative to each other to increase the distance between the two opposite fixing devices for mounting the frame of the racket.

At this time, the two foot posts 80 are pushed to move outward on the guide plate 20, and the first end of the press rod 40 slips on the ratchet teeth 12 of the rack 10. In such a manner, as shown in FIG. 5, the two foot posts 80 can be moved outward freely and cannot be moved inward by provision of the oneway ratchet teeth 12 of the rack 10. Thus, the two foot posts 80 can be moved outward through a larger distance rapidly, thereby largely adjusting the distance between the two opposite fixing devices easily and conveniently.

After the two opposite fixing devices are moved outward to reach the position of the frame of the racket, the rotation head 42 of the press rod 40 is rotated as shown in FIG. 6 to slightly change the position of the first end of the press rod 40 relative to the ratchet teeth 12 of the rack 10, so that the two foot posts 80 can be moved on the guide plate 20 reciprocally to microadjust the distance between the two opposite fixing devices to fit the exact position of the frame of the racket, so that the frame of the racket is clamped between the two opposite fixing devices exactly for stretching the strings of the racket.

After the work of stretching the strings of the racket is finished, the rotation head 42 of the press rod 40 is pressed downward as shown in FIG. 7, so that the press rod 40 is pivoted about the support shaft 30 to detach the first end of the press rod 40 from the ratchet teeth 12 of the rack 10. In such a manner, the two foot posts 80 can be moved inward freely so as to fold the two opposite fixing devices. After the force applied on the rotation head 42 of the press rod 40 is removed, the support shaft 30 can be returned to the original state by the restoring force of the torsion spring 34, so that the press rod 40 is pivoted about the support shaft 30 reversely to lock the first end of the press rod 40 on the ratchet teeth 12 of the rack 10.

Accordingly, the two foot posts 80 can be directly pushed to move outward through a larger distance to largely adjust the distance between the two opposite fixing devices easily and conveniently without having to release the locking state of each of the two opposite fixing devices. After the two opposite fixing devices are moved to reach the position of the frame of the racket, the rotation head 42 of the press rod 40 is rotated to microadjust the distance between the two opposite fixing devices to fit the exact position of the frame of the racket, so that the frame of the racket is clamped between the two opposite fixing devices exactly. After the work of stretching the strings of the racket is finished, the rotation head 42 of the press rod 40 is pressed downward to detach the first end of the press rod 40 from the ratchet teeth 12 of the rack 10, thereby releasing the locking state of each of the two fixing devices, so that the two foot posts 80 can be moved inward freely and rapidly so as to fold the two opposite fixing devices.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A racket stringer, comprising a work table, and two opposite fixing devices each mounted on the work table and each including a rack, a guide plate, two foot posts, a support shaft, and a press rod, wherein:

the rack is mounted on the top of the work table and has a top face formed with a plurality of oneway ratchet teeth;

the guide plate is mounted on the top of the work table and is formed with two elongated guide slots each parallel with the rack;

each of the two foot posts is slidably mounted on the guide plate and has a bottom provided with a slide slidably mounted in a respective one of the two guide slots of the guide plate, thereby guiding the fixing device to displace on the work table reciprocally;

the support shaft is rotatably mounted between the two foot posts;

the press rod is extended through the support shaft and has a first end rested on the ratchet teeth of the rack and a second end formed with a rotation head for rotating the press rod;

each of the fixing devices further includes:

a support plate mounted on the bottom of the work table for supporting and securing the rack, and a plurality of locking screws each extended through the support plate and the work table and each locked in the guide plate; and a connecting seat mounted on the bottom of the support plate and secured on the slides of the two foot posts, and a plurality of locking bolts each extended through the connecting seat and the slides and each locked in a respective one of the two foot posts.

2. The racket stringer in accordance with claim 1, wherein the guide plate is formed with a receiving slot to receive the rack.

3. The racket stringer in accordance with claim 1, wherein the work table is formed with two elongated guide slots each aligning with a respective one of the two guide slots of the guide plate for guiding the slide of a respective one of the two foot posts.

4. The racket stringer in accordance with claim 1, wherein the work table is formed with a receiving slot to receive the rack.

5. The racket stringer in accordance with claim 1, wherein the support plate is formed with two elongated guide slots each aligning with a respective one of the two guide slots of the guide plate for guiding the slide of a respective one of the two foot posts.

6. The racket stringer in accordance with claim 1, wherein the support shaft is formed with a screw bore, and the press rod is formed with an outer thread screwed into the screw bore of the support shaft.

7. The racket stringer in accordance with claim 1, wherein each of the fixing devices further includes a torsion spring mounted between the support shaft and one of the two foot posts and having a first end secured on the support shaft and a second end secured on the respective foot post.

8. The racket stringer in accordance with claim 7, wherein the support shaft has an end formed with a receiving recess to receive the torsion spring.

9. The racket stringer in accordance with claim 1, wherein each of the fixing devices further includes a support base mounted between the two foot posts and having a top provided with a press plate.

10. The racket stringer in accordance with claim 9, wherein each of the fixing devices further includes two positioning posts mounted on the support base.

* * * * *